US005636685A

United States Patent [19]

Gawve et al.

[11] Patent Number: 5,636,685

[45] Date of Patent: Jun. 10, 1997

[54] PLATE AND FIN OIL COOLER WITH IMPROVED EFFICIENCY

[75] Inventors: Warren L. Gawve, Lockport; Duane V. Beales, Gasport, both of N.Y.

[73] Assignee: General Motors Corporation, Detroit, Mich.

[21] Appl. No.: 698,633

[22] Filed: Aug. 16, 1996

[51] Int. Cl.[6] ..... F28F 13/12

[52] U.S. Cl. ..... 165/109.1; 165/166; 165/183; 165/916

[58] Field of Search ..... 165/109.1, 183, 165/916, 166, 167; 138/38

[56] References Cited

U.S. PATENT DOCUMENTS 2,329,789 9/1943 Schank et al. .
4,945,981 8/1990 Joshi ..... 165/109.1
5,029,636 7/1991 Kadle ..... 165/109.1
5,184,672 2/1993 Aoki ..... 165/109.1
5,538,077 7/1996 So et al. ..... 165/109.1

*Primary Examiner*—Leonard R. Leo
*Attorney, Agent, or Firm*—Patrick M. Griffin

[57] ABSTRACT

A plate type oil cooler has a louvered cooling fin with corrugations running transverse to the axis of the plates. The plates have central flat areas spaced from each other by a constant thickness, each of which transitions into a marginal edge across a semi-cylindrical area of progressively decreasing thickness. The cooling fin has its height tapered and reduced at the side edges in such a way as to fit between the semi-cylindrical areas of the opposed plates without binding. This is achieved by stamping the side edges of the fin walls with localized indentations which pull the fin height in enough to match the reduced thickness areas of the plates. Therefore, the bypass oil flow areas that would otherwise exist are at least partially blocked, improving thermal efficiency.

3 Claims, 3 Drawing Sheets

PLATE AND FIN OIL COOLER WITH IMPROVED EFFICIENCY

This invention relates to oil coolers of the type having a corrugated fin captured between a pair of plates, and specifically to such an oil cooler in which the fin is modified so as to fill a greater proportion of the volume between the plates, for improved thermal efficiency.

BACKGROUND OF THE INVENTION

Transmission oil coolers of the type that are carried within one of the radiator tanks include at least a pair of generally rectangular plates between which is captured a cooling fin of some sort. The plates define an oil inlet at one end and outlet at the other, so that the oil flow is generally longitudinal. The cooling fin, around and through which the hot oil flows, conducts heat out to the plates which, in ram, are continually bathed in the cooler radiator coolant. Because of the hot and corrosive environment; the fin is made from steel, as opposed to the softer copper and aluminum generally found on the air side of radiators, condensers and the like. Typically, the shape of such steel oil cooler fins was a "lace curtain" turbulator, which, unlike the corrugated "air center" found in radiators, did not have distinct fin walls as such. Lately, however, it has been found that the incorporation of a true, corrugated cooling fin, with fin walls joined to one another in a series of V shapes, can significantly improve performance. As disclosed in co-assigned U.S. Pat. No. 4,945,981 issued Aug. 7, 1990 to Joshi, a corrugated fin is captured between the plates, embodied either as a fin with shorter fin walls extending across the width of the plates (transverse to the axis of the plates), or longer fin walls running parallel the axis of the plates. The transverse fin wall embodiment has been used in actual production, and its fin walls are pierced by sharp angle louvers to allow the oil to flow end to end of the cooler. Otherwise, the transverse running fin walls would block oil flow.

The transverse fin wall embodiment from the above patent has presented a manufacturing problem not evident from the disclosure therein, or, more accurately, a problem in achieving optimal thermal efficiency within the limits of manufacturability. The drawings in the patent, which was concerned only with the shape of the fin, do not accurately reflect the actual shape of the plates, at least the shape near the marginal edges of the plates. As seen in FIGS. 1 and 2 of the drawings, which accurately depicts the shape of an actual production embodiment, oil cooler 10 has at least two plates, (an actual cooler could include a number of plate pairs stacked together), a lower or "male" plate 12 and an upper or "female" plate 14. The plates are so denominated because the male plate 12 is slightly narrower (and slightly shorter) so as to fit inside the female plate 14 all the way around to create a continuous overlapped seam around the margin, at which the two are brazed together. One or both plates is ported at each end so that oil flows along and between the plates 12 and 14, as shown by the arrows, along the longitudinal axis A. Although each is symmetrical about its axis and generally rectangular, neither plate 12 nor 14 is sharp cornered at the ends, but instead rounded off into a semi-circular end shape. Furthermore, neither has a sharp, fight angled comer at the margins. Instead, as best seen in FIGS. 2 and 3, each makes a more rounded transition into its marginal edge, all the way around. For example, upper plate 14 has a central flat area 16, the width of which comprises most of its total width $W_1$. The total width $W_1$ will vary over particular designs. Outboard of the flat area 16, lower plate 12 makes a gradual, generally semi-cylindrical transition into its marginal edge 18, over a distance of about 0.075 inches, which, while narrow, is still a significant percentage of its total width. Likewise, lower plate 12, which has a slightly smaller width $W_2$, just enough smaller than $W_1$ to accommodate the upper plate 14 being interfitted snug over its marginal edge 18). Lower plate 12 makes the same semi-cylindrical transition from a central flat area 20 (which has nearly the same width as flat area 16) down to marginal edge 22, and over approximately the same distance.

The reason for the semi-cylindrical shape of the transition areas along the margins of the plates 12 and 14, besides avoiding stress concentrations at sharp corners, is to allow the two plates to be crimped together, as shown in FIGS. 2 and 3. A pair of clinch dies, not illustrated, pushes the two plates together, and the upper clinch dies progressively bends the initially straight marginal edge 22 of upper plate 14 around and over the marginal edge 22 of lower plate 12 to create a smooth, snug overlapped seam, clearly seen in FIG. 3. Another consequence of the rounded comers of the plates 12 and 14 is not so obvious. The corrugated steel fin 24 that is captured between the plates 12 and 14 has corrugations that run transverse to the axis A. It has an effective fin height H which is substantially equal to the axial separation or thickness T, which is about 0.133 inches as disclosed. The term "effective fin height" indicates that the fin height acting to separate the plates 12 and 14 is a function of the total, peak to peak fin wall length, as well as the angle of the fin wall. If the fin walls are parallel (zero angle), then the fin wall length and fin height are one and the same. Given the strong material from which the fin 24 is formed, its corrugations, once captured and confined between the plates 12 and 14, are very stiff. Therefore, the total, side edge to side edge width of fin 24 transverse to the axis A cannot be made significantly greater than the corresponding width of the plate central flat areas 16 and 20. Otherwise, the side edges of fin 24 would intrude out into the semi cylindrical transition areas between the plates 12 and 14 located outboard of the flat areas 16 and 20. If the intrusion were too great, the stiffness of fin 24 could overpower the clinch dies, jeopardizing the integrity of the seam formed between the overlapping marginal edges 18 and 22. As a consequence, a bypass area indicated at B is left open, which borders both sides of fin 24, running end to end of the cooler 10. The bypass area B is essentially a half round pipe with a radius (or width) equal to the distance over which the plate flat areas 16, 20 and transition into the marginal edges 18, 22, or about 0.075 inches. The width of the bypass area B is a significant percentage of the total width of the cooler 10. Since by pass area B presents a much lower resistance to flow than the louvered fin 24 itself, a significant volume of oil can flow through it, and not through the fin 24, thereby reducing the potential thermal efficiency of oil cooler 10. There is no obvious way to extend the width of a fin like 24 out into the bypass area B without jeopardizing its manufacturability.

SUMMARY OF THE INVENTION

The invention provides an effectively wider cooling fin of the type described above, which does extend out into a good portion of the bypass area between the plates, improving thermal efficiency. However, a novel design of the fin serves to reduce its height in that area sufficiently so as to not jeopardize the edge seam between the plates.

In the preferred embodiment disclosed, the oil cooler has a pair of spaced plates of identical size, shape and thickness to those described above. The cooling fin captured between the plates has the same general configuration of corrugated fin walls running transverse to the length axis of the plates. The fin walls are louvered to allow oil flow through them, and the central height of the fin is equal to the thickness between the flat areas of the plates. However, the outermost, side edge of each fin wall is formed with a localized indentation, which is large enough to draw in and shorten the effective fin wall height at and near the edge. The fin wall is shortened sufficiently to, in turn, allow some of the fin wall width to extend out into and block a good deal of the bypass area. The shortened fin height at the side edges prevents the fin from binding between the plates or interfering with the operation of the clinch dies as they push the plates together. Therefore, total thermal efficiency is improved with only a small change to the fin manufacturing process, and no change to the basic assembly process of the cooler itself.

DESCRIPTION OF THE PREFERRED EMBODIMENT

Figure 7:
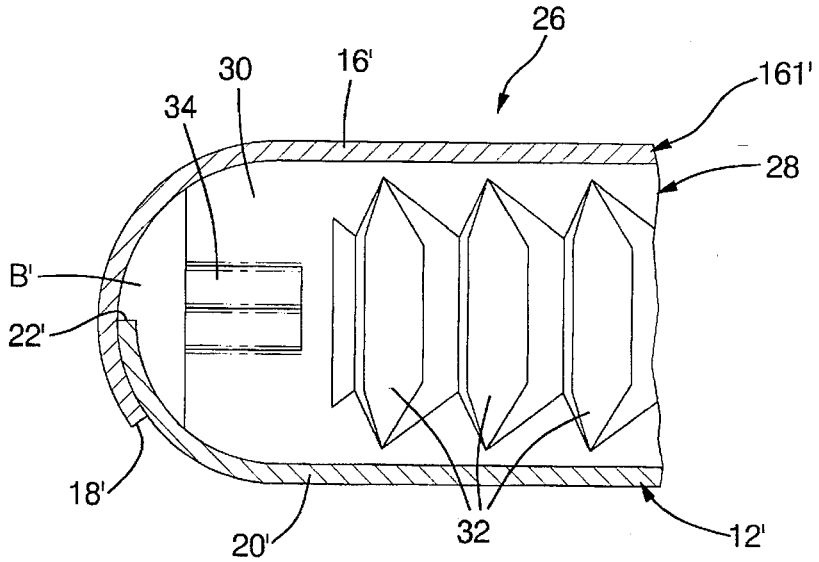
FIG. 7 is a view like FIG. 3, but showing the cooling fin of the invention captured between the two plates.

Referring first to FIG. 7, a completed oil cooler made according to the invention is indicated generally at 26. It incorporates the same two plates, with the same size, shape and thickness T, and these are so indicated by the same numbers primed (′). In addition, the two plates 12′ and 14′ are assembled in the same manner, and with the same tooling. Oil would run in the same direction, end to end, along the same axis. It will be readily apparent, however, that the corresponding bypass area B′ has a much smaller cross sectional area, as compared to the prior art oil cooler 10. The reason for this is the different cooling fin, indicated generally at 28, and described in detail next.

Figure 4:
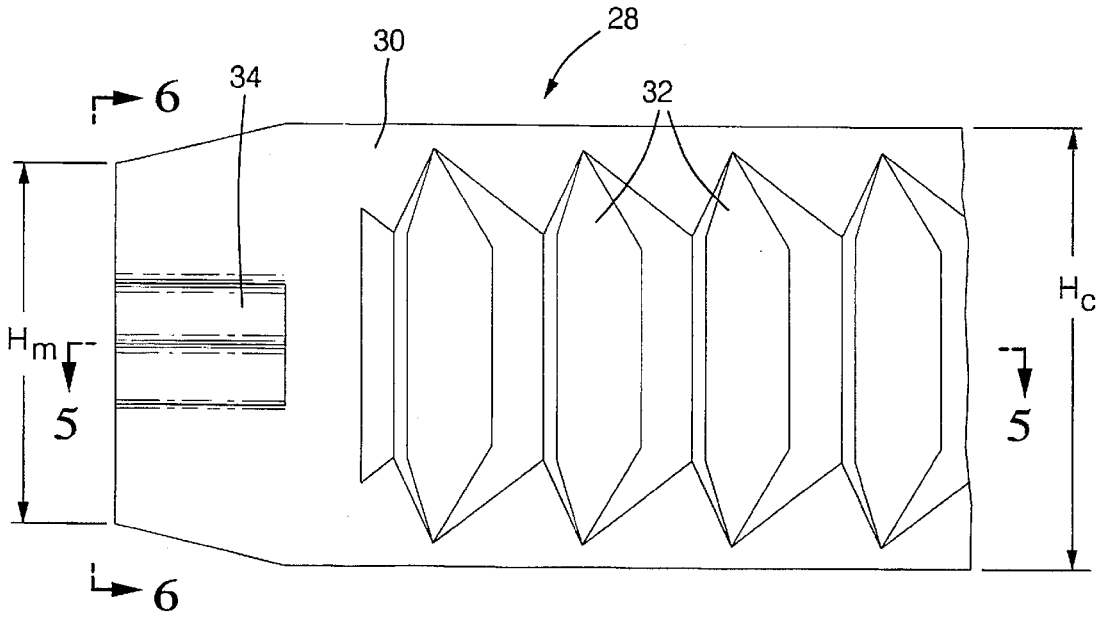
FIG. 4 is a view showing one side of a fin wall from a preferred embodiment of a cooling fin made according the invention.
Figure 5:
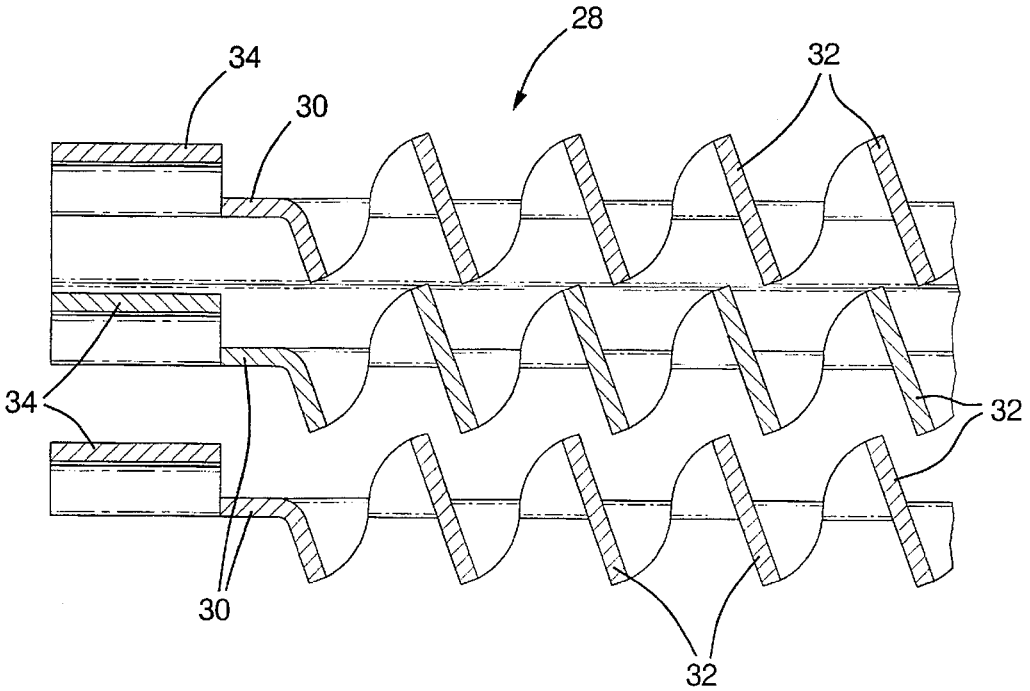
FIG. 5 is a cross section taken in a plane lying in the line 5—5 of FIG. 4.
Figure 6:
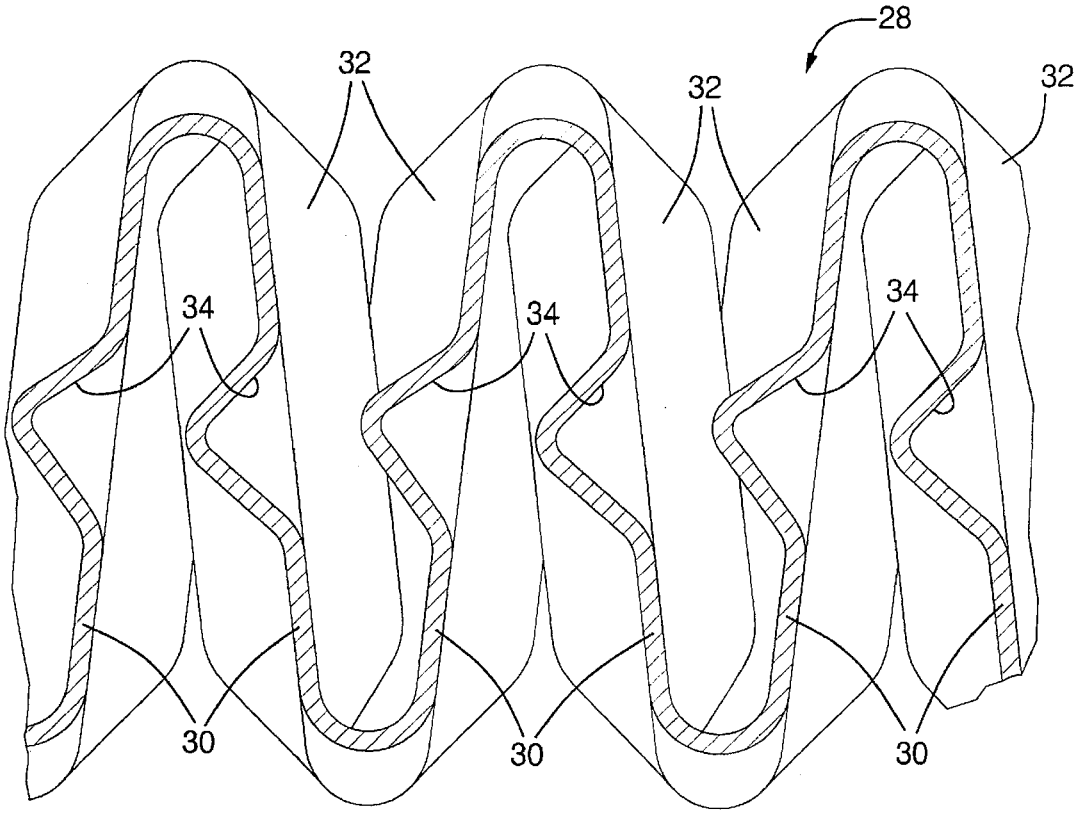
FIG. 6 is a cross section taken in a plane lying in the line 6—6 of FIG. 4.

Referring next to FIGS. 4–6, corrugated cooling fin 28 is the same general type as fin 24. Many structural features of fin 28 are common to the older fin 24, including its material. It has a plurality of flat fin walls 30 integrally folded into a series of V shaped corrugations, the peaks of which run transverse to the axis of cooler 26 from side edge to side edge. The central area of each fin wall 30 is pierced by a double pattern of sharply sloped louvers 32, around and through which the oil flows. The height of fin 28 is similar to fin 24 in the center, but that central height does not run all the way, edge to edge, across the fin walls 30, as it does with fin 24. Specifically, the central effective height of each fin wall 30, indicated at Hc in FIG. 4, is the same as the thickness T (0.133 inches) between the flat central areas 16′ and 20′ of the two plates 14′ and 12′, as described above. The fin walls 30 carry that central height Hc over a central width that corresponds approximately the widths of the plate central flat portions 16′ and 20′. The total width of fin 28 is greater than fin 24, however. At the very side edges the height of the fin walls 30 is shorter, approximately. 0.113 inches, indicated at Hm. The margin or edge height Hm widens back in a continuous taper to the basic central height He, over a distance of approximately 0.05 inches, which represents the greater width on each side that fin 28 has. The decrease in fin height at and near the side edges of the fin walls 30 is achieved by giving each fin edge a generally V shaped, centrally located indentation 34, with a length (measured in the same direction as the width of fin wall 30) of approximately 0.05 inches, a depth of about 0.03 inches, and a width comparable to the depth. The indentation 34 serves to effectively shorten the edge length of the fin wall 30, thereby shortening the effective height of the fin wall 30 at and near the side edge. The height tapers continuously from Hm back to Hm, rather than changing abruptly or step wise where the indentation 34 starts, because of the resistance of the rest of the fin wall 30 to being shortened. The indentations 34 are created during the forming process of fin 28 by adding similarly shaped toothed projections to the forming wheels that fold the fin walls 30 and pierce the louvers 32.

Figure 1:
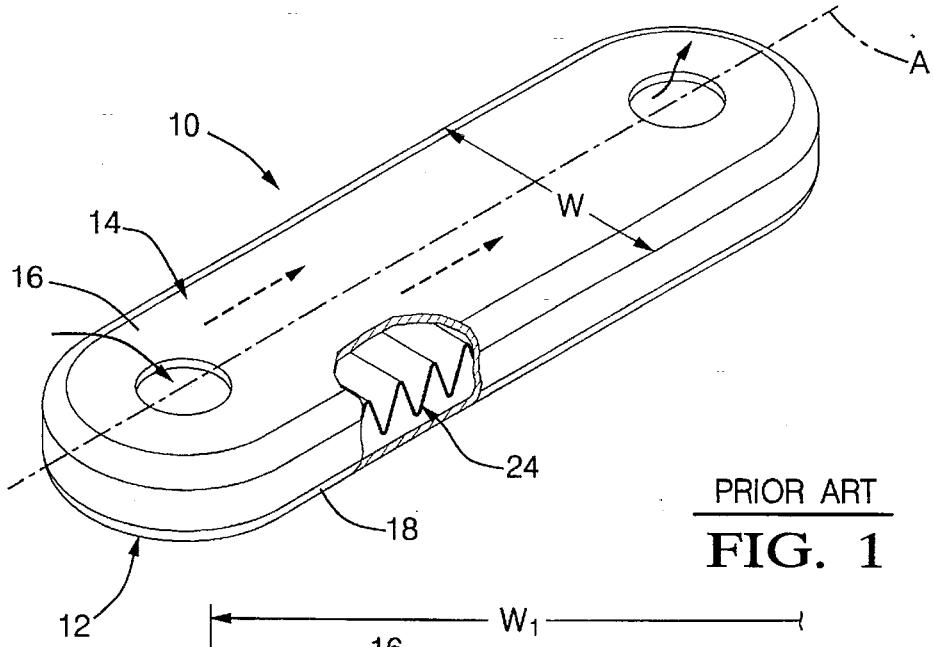
PRIOR ART FIG. 1
FIG. 1 is a perspective view of a prior art oil cooler of the general type involved in the subject invention.
Figure 2:
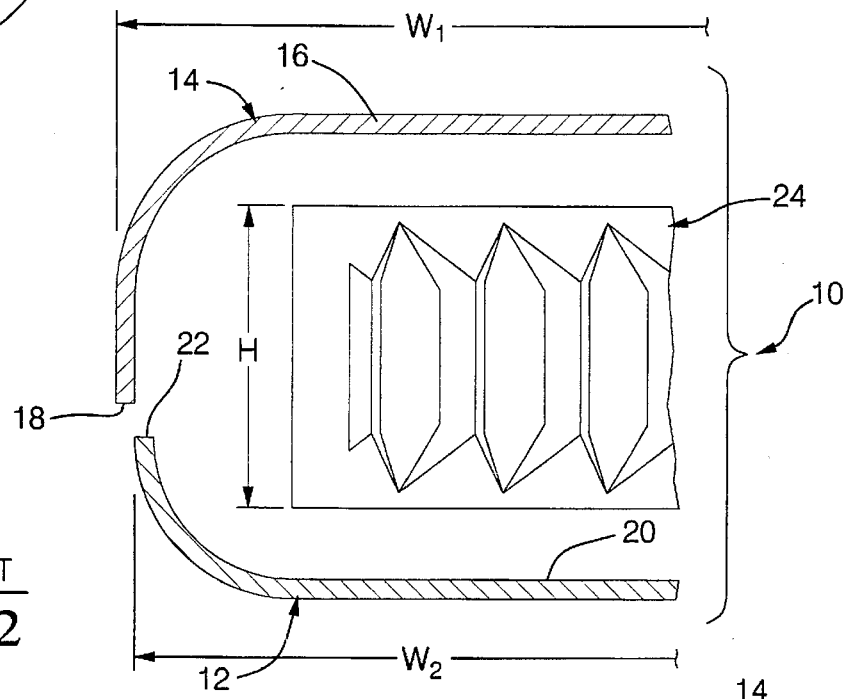
PRIOR ART FIG. 2
FIG. 2 is an enlarged view of a cross section through one side of the oil cooler of FIG. 1, before the two plates are crimped together.
Figure 3:
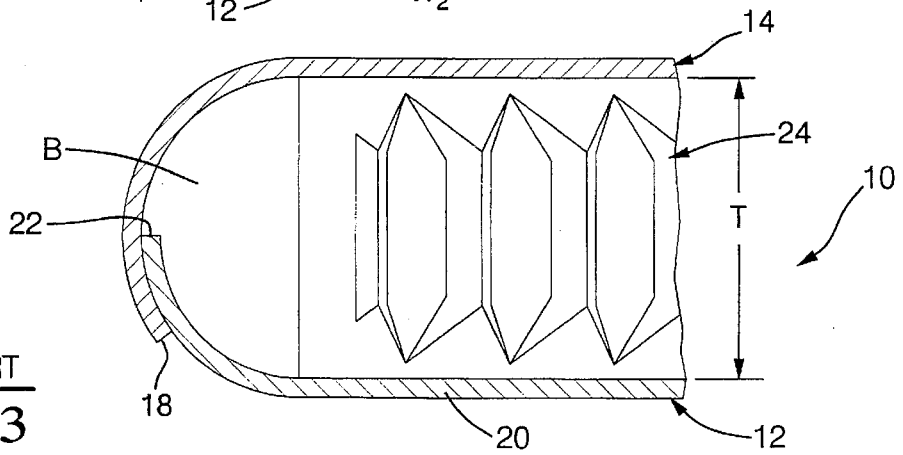
PRIOR ART FIG. 3
FIG. 3 shows the two plates in FIG. 2 after being crimped together over a conventional cooling fin.

Referring next to FIGS. 7 and 3, the purpose for decreasing the effective height of the fin walls 30 at and near the sides is illustrated. The fin 28, just as with fin 24, is placed between the plates 12′ and 14′. Fin 28, however, because of its tapered height near the side edges and greater total width, can self locate into and onto the lower, male plate 12′, centering itself by settling between the semicylindrical areas. The plates 12′ and 14′ are then crimped together. The tapered shape near the side edges of the fin 28 matches the shape of the semi-cylindrical areas of the plates 12′ and 14′ well enough so as to not interfere with the clinching process described above, as would a conventional fin of comparable width and constant fin wall height. Furthermore, to the extent that any part of the fin 28 near its side edges would bind between the plates 12′ and 14′ during the crimping process, the V shape of the concave indentations 34 acts as a hinge, providing a resilient flex point allowing the fin walls 30 to collapse slightly, if necessary, to prevent any, binding and spring back that might other wise occur. The main advantage of the novel shape is operational, however. By decreasing the fin wall height beginning at a point corresponding to the point where the plates 12′ and 14′ begin to make the transition from the flat areas 20′, 16′ into the marginal edges 22′, 18′, the fin walls 30 are thereby able to extend outboard farther and into what would have otherwise been a larger bypass area like B (FIG. 3). This leaves a significantly smaller bypass area B′. Specifically, the decreased height area of the fin walls 30 extends out by about 0.05 inches into (and partially blocking) the original approximately 0.075 inch unblocked width of the prior bypass area B. As a consequence, the mount of oil that can flow down the now much smaller bypass area B′ is significantly reduced, with a corresponding increase in thermal efficiency. Now, the trapezoidal cross section of the reduced height area of the fin walls 30 does not make a perfect fit within and against the opposed semi-cylindrical areas of the two tube plates 12′ and 14′. The fit up against the inside surface of the plates 12′ and 14′ need not be perfect, however, since the intent is simply to block most of the flow through the bypass area B′, not to seal it tight. While not all of the original bypass area B of FIG. 3 is blocked, even if the reduced height area of the fin walls 30 extends out only about halfway into it, then much more than half of its cross sectional area will be filled up and blocked out, because of the geometric characteristics of a semi circle. Therefore, an improvement in thermal performance is gained with no change to the plates 12' and 14', no change to or interference with the assembly and installation process, and with an inexpensive change to the shape of fin 28 (a shape produced with no significant change to the method of manufacturing fin 28).

Variations in the embodiment disclosed could be made. The shape of the indentation 34 could be modified, to a more squared off or even semi-cylindrical cross section, which would still act to locally shorten the side edge length of the fin wall 30. However, the V shaped indentation 34 does give the resilient, self conforming give noted above to further assure that fin 28 does not interfere with the crimping process. As disclosed, the indentations 34 all open or face in the same direction. However, they could alternate as to opening direction which, if they were directly opposed to one another on each adjacent pair of fin walls 30, would hold their depth to approximately half of the pitch between the fin walls 30. That would not likely be a limiting factor, however, in most cases, unless the fin wall pitch were very small. The indentations 34 could be shorter, that is, their length could begin outboard of the point on the fin wall 30 that corresponds to the line where the narrowing transition from the plate central flat area down to the marginal edge begins, rather than right at or inboard of that line, as disclosed. The conformation of the fin to the semi-cylindrical areas would not be as close, but a shorter indentation which also had a greater depth and width might pull the effective fin wall height down abruptly enough to clear the semi-cylindrical areas of the plates form well enough. As just suggested, the indentations 34, whatever their length, need not necessarily have a constant width and depth all along their length, that is, a cross section that is constant at all points along their length. They could, for example, widen or deepen at points nearer the side edges of the fin walls 30 so as reduce the edge length and effective height of the fin wall 30 proportionately more at points nearer the side edge. This could potentially better match the height of the fin walls 30 to the profile of the semi-cylindrical areas of the plates, and allow the fin width to extend out even farther into the bypass areas. However, it would be more difficult to cut the tooling that would produce an indentation with a cross section that varied along its length. Therefore, it will be understood that it is not intended to limit the invention to just the embodiment disclosed.

We claim:

1. A plate type oil cooler, comprising, first and second, generally rectangular, opposed parallel plates joined together at interfitted marginal edges, each plate being generally symmetrical about a longitudinal axis and having a total width measured perpendicular to said axis and between said marginal edges, each plate having a substantially flat central area narrower than the total width and defining a central thickness relative to the parallel central flat area of the opposed plate, said plates transitioning to said marginal edges from said central flat areas across a generally semi-cylindrical area, so that the thickness between said plates outboard of said central flat areas is progressively less than said central thickness between said central flat areas and marginal edges, and, a corrugated cooling fin captured between said first and second opposed plates having a series of fin walls extending between side edges thereof generally perpendicular to said longitudinal axis, said fin walls having an effective central height substantially equal to said plate central thickness, each of said fin walls also having a localized indentation formed at the side edges thereof so as to shorten the edge length thereof and thereby reduce the effective height of said fin walls proximate the side edges thereof to sufficiently less than said central effective height so as to fit between said plates without binding therebetween outboard of said plate central flat areas, thereby filling a greater proportion of the total width of said plates.

2. A plate type oil cooler, comprising, first and second, generally rectangular, opposed parallel plates joined together at interfitted marginal edges, each plate being generally symmetrical about a longitudinal axis and having a total width measured perpendicular to said axis and between said marginal edges, each plate having a substantially flat central area narrower than the total width and defining a central thickness relative to the parallel central flat area of the opposed plate, said plates transitioning to said marginal edges from said central flat areas across a generally semi-cylindrical area, so that the thickness between said plates outboard of said central flat areas is progressively less than said central thickness between said central flat areas and marginal edges, and, a corrugated cooling fin captured between said first and second opposed plates having a series of fin walls extending between side edges thereof generally perpendicular to said longitudinal axis, said fin walls having an effective central height substantially equal to said plate central thickness, each of said fin walls also having a generally V shaped indentation formed at the side edges thereof so as to shorten the edge length thereof and thereby reduce the effective height of said fin walls proximate the side edges thereof to sufficiently less than said central effective height as well as providing a flex point so as to fit between said plates without binding therebetween outboard of said plate central flat areas, thereby filling a greater proportion of the total width of said plates.

3. A plate type oil cooler, comprising, first and second, generally rectangular, opposed parallel plates joined together at interfitted marginal edges, each plate being generally symmetrical about a longitudinal axis and having a total width measured perpendicular to said axis and between said marginal edges, each plate having a substantially flat central area narrower than the total width and defining a central thickness relative to the parallel central flat area of the opposed plate, said plates transitioning to said marginal edges from said central flat areas across a generally semi-cylindrical area, so that the thickness between said plates outboard of said central flat areas is progressively less than said central thickness between said central flat areas and marginal edges, and, a corrugated cooling fin captured between said first and second opposed plates having a series of fin walls extending between side edges thereof generally perpendicular to said longitudinal axis, said fin walls having an effective central height substantially equal to said plate central thickness, each of said fin walls also having a generally V shaped indentation formed at the side edges thereof having a substantially constant cross section along its length, so as to shorten the edge length thereof and thereby reduce the effective height of said fin walls proximate the side edges thereof to sufficiently less than said central effective height as well as providing a flex point so as to fit between said plates without binding therebetween outboard of said plate central flat areas, thereby filling a greater proportion of the total width of said plates.

* * * * *